US011688207B2

(12) United States Patent
Levy et al.

(10) Patent No.: US 11,688,207 B2
(45) Date of Patent: Jun. 27, 2023

(54) SYSTEM AND METHOD FOR CONTEXTUALLY MONITORING VEHICLE STATE

(71) Applicant: Upstream Security, Ltd., Herzliya (IL)

(72) Inventors: Yoav Levy, Kfar-Vitkin (IL); Yonatan Appel, Ramat Hasharon (IL); Dekel Moshka, Tel Aviv (IL)

(73) Assignee: UPSTREAM SECURITY, LTD., Herzliya (IL)

( * ) Notice: Subject to any disclaimer, the term of this patent is extended or adjusted under 35 U.S.C. 154(b) by 480 days.

(21) Appl. No.: 16/451,569

(22) Filed: Jun. 25, 2019

(65) Prior Publication Data

US 2020/0035044 A1 Jan. 30, 2020

Related U.S. Application Data

(60) Provisional application No. 62/703,713, filed on Jul. 26, 2018.

(51) Int. Cl.
*G07C 5/00* (2006.01)
*G07C 5/08* (2006.01)

(52) U.S. Cl.
CPC ..... *G07C 5/008* (2013.01); *G07C 5/085* (2013.01); *G07C 5/0808* (2013.01); *G07C 5/0816* (2013.01)

(58) Field of Classification Search
CPC ..... G07C 5/008–085
See application file for complete search history.

(56) References Cited

U.S. PATENT DOCUMENTS

| | | | | |
|---|---|---|---|---|
| 7,102,496 | B1 | 9/2006 | Ernst, Jr. et al. | |
| 7,389,178 | B2 | 6/2008 | Raz et al. | |
| 8,463,488 | B1 | 6/2013 | Hart | |
| 9,398,423 | B2 | 7/2016 | Cordova et al. | |
| 9,923,931 | B1 * | 3/2018 | Wagster | H04L 63/30 |
| 2006/0142913 | A1 * | 6/2006 | Coffee | B60P 3/03 701/29.3 |
| 2017/0349182 | A1 | 12/2017 | Cordova et al. | |
| 2018/0157923 | A1 * | 6/2018 | el Kaliouby, Jr. | G06V 40/174 |
| 2018/0276912 | A1 * | 9/2018 | Zhou | G07C 5/0808 |

(Continued)

FOREIGN PATENT DOCUMENTS

| | | | | |
|---|---|---|---|---|
| DE | 102018208191 A1 * | 1/2019 | | B25J 9/1674 |
| WO | WO-02031793 A3 * | 12/2002 | | G07C 5/008 |

OTHER PUBLICATIONS

EP 2631878 A1 with English translation (Year: 2013).*

*Primary Examiner* — Calvin Cheung
(74) *Attorney, Agent, or Firm* — M&B IP Analysts, LLC

(57) ABSTRACT

A system and method for contextually monitoring vehicle states. The method includes enriching a plurality of messages based on at least one missing property value and a plurality of predictive properties in the plurality of messages, wherein at least one message of the plurality of messages is generated by a vehicle monitoring system, wherein each message of the plurality of messages is ingested at a vehicle state monitor, wherein each of the predictive properties is a property indicated in one of the plurality of messages of a predetermined type of property; and generating a contextual vehicle state for a vehicle based on the enriched plurality of messages, wherein the contextual vehicle state is a snapshot of a plurality of vehicle state properties at a given time.

21 Claims, 7 Drawing Sheets

(56) References Cited

U.S. PATENT DOCUMENTS

| | | | | |
|---|---|---|---|---|
| 2018/0293816 | A1* | 10/2018 | Garrett | B60R 16/0234 |
| 2019/0190857 | A1* | 6/2019 | Zhou | G07C 5/008 |
| 2020/0189100 | A1* | 6/2020 | Racz | B25J 9/1643 |

* cited by examiner

SYSTEM AND METHOD FOR CONTEXTUALLY MONITORING VEHICLE STATE

CROSS-REFERENCE TO RELATED APPLICATIONS

This application claims the benefit of U.S. Provisional Application No. 62/703,713 filed on Jul. 26, 2018, the contents of which are hereby incorporated by reference.

TECHNICAL FIELD

The present disclosure relates generally to vehicle telemetries, and more specifically to contextualizing vehicle states based on vehicle telemetries.

BACKGROUND

With advances in computer technology, computerized navigation and control systems in vehicles have been created to improve drivers' experiences and to allow for remotely controlled transportation of people and goods. To this end, computerized control and management services may collect data remotely from systems deployed in vehicles. For example, a navigation system installed in a vehicle may collect and upload (e.g., via a cellular network) telemetry data such as internal data (e.g., mechanical data, electronics data, or both) related to components of the vehicle, location data, functional data related to vehicle activities (e.g., movements, use of horn, etc.), and other types of data. Prior to introduction of such computerized control and management systems, collection of such data was not possible.

While computerized control and management systems can be incredibly valuable for users, these systems leave vehicles exposed to new dangers. Specifically, malicious entities can control vehicle functions and, therefore, may misappropriate the vehicle for their own purposes. This opens the door to vehicle failure, theft, and other malicious activity, which can lead to death, injury, and financial damage. For example, a cyber attacker may be able to control driving systems, lock and unlock the car, turn the engine on or off, and the like.

Additionally, otherwise benign entities (such as an owner, renter, or other user of the vehicle) may misuse the vehicle. Specifically, a vehicle user may allow an unauthorized person to drive the vehicle in violation of laws or employment, lease, or insurance agreements. Identifying unauthorized use of vehicles may therefore be of interest to drivers, fleet managers, business partners, insurance companies, and other entities related to the vehicle.

Before computerized control and management systems, detecting vehicle misuse was only possible via manual observations of, for example, driving behavior and performance. However, existing solutions based on computerized control and management systems often have false positives or negatives in identifying vehicle misuse violations at least because they fail to account for a current context of the vehicle's state when detecting potential violations. For example, some existing solutions can be configured to check vehicle speed to detect if the vehicle has exceeded a preconfigured maximum speed but cannot dynamically identify violations of rules that change depending on context such as adjusting speed thresholds based on changes in an internal state of the vehicle (e.g., changes in yaw velocity).

A challenge faced by existing solutions is that data from different sources typically cannot be directly compared.

Thus, a large amount of data can be collected, but in practice only a portion of that data may be analyzed at once. Further, even when data from different sources is aggregated, meaningful inferences regarding vehicle state cannot be determined. Additionally, large-scale vehicle monitoring solutions face challenges due to bottlenecks caused by simultaneous access to global data stores. These bottlenecks are caused by large demands on computing resources when a large amount of data intake occurs.

It would therefore be advantageous to provide a solution that would overcome the challenges noted above.

SUMMARY

A summary of several example embodiments of the disclosure follows. This summary is provided for the convenience of the reader to provide a basic understanding of such embodiments and does not wholly define the breadth of the disclosure. This summary is not an extensive overview of all contemplated embodiments, and is intended to neither identify key or critical elements of all embodiments nor to delineate the scope of any or all aspects. Its sole purpose is to present some concepts of one or more embodiments in a simplified form as a prelude to the more detailed description that is presented later. For convenience, the term "some embodiments" or "certain embodiments" may be used herein to refer to a single embodiment or multiple embodiments of the disclosure.

Certain embodiments disclosed herein include a method for contextually monitoring vehicle states. The method comprises: enriching a plurality of messages based on at least one missing property value and a plurality of predictive properties in the plurality of messages, wherein at least one message of the plurality of messages is generated by a vehicle monitoring system, wherein each message of the plurality of messages is ingested at a vehicle state monitor, wherein each of the predictive properties is a property indicated in one of the plurality of messages of a predetermined type of property; and generating a contextual vehicle state for a vehicle based on the enriched plurality of messages, wherein the contextual vehicle state is a snapshot of a plurality of vehicle state properties at a given time.

Certain embodiments disclosed herein also include a non-transitory computer readable medium having stored thereon causing a processing circuitry to execute a process, the process comprising: enriching a plurality of messages based on at least one missing property value and a plurality of predictive properties in the plurality of messages, wherein at least one message of the plurality of messages is generated by a vehicle monitoring system, wherein each message of the plurality of messages is ingested at a vehicle state monitor, wherein each of the predictive properties is a property indicated in one of the plurality of messages of a predetermined type of property; and generating a contextual vehicle state for a vehicle based on the enriched plurality of messages, wherein the contextual vehicle state is a snapshot of a plurality of vehicle state properties at a given time.

Certain embodiments disclosed herein also include a system for contextually monitoring vehicle states. The system comprises: a processing circuitry; and a memory, the memory containing instructions that, when executed by the processing circuitry, configure the system to: enrich a plurality of messages based on at least one missing property value and a plurality of predictive properties in the plurality of messages, wherein at least one message of the plurality of messages is generated by a vehicle monitoring system, wherein each message of the plurality of messages is ingested at a vehicle state monitor, wherein each of the predictive properties is a property indicated in one of the plurality of messages of a predetermined type of property; and generate a contextual vehicle state for a vehicle based on the enriched plurality of messages, wherein the contextual vehicle state is a snapshot of a plurality of vehicle state properties at a given time.

BRIEF DESCRIPTION OF THE DRAWINGS

The subject matter disclosed herein and other objects, features, and advantages of the disclosed embodiments will be apparent from the following detailed description taken in conjunction with the accompanying drawings.

DETAILED DESCRIPTION

Figure 1:
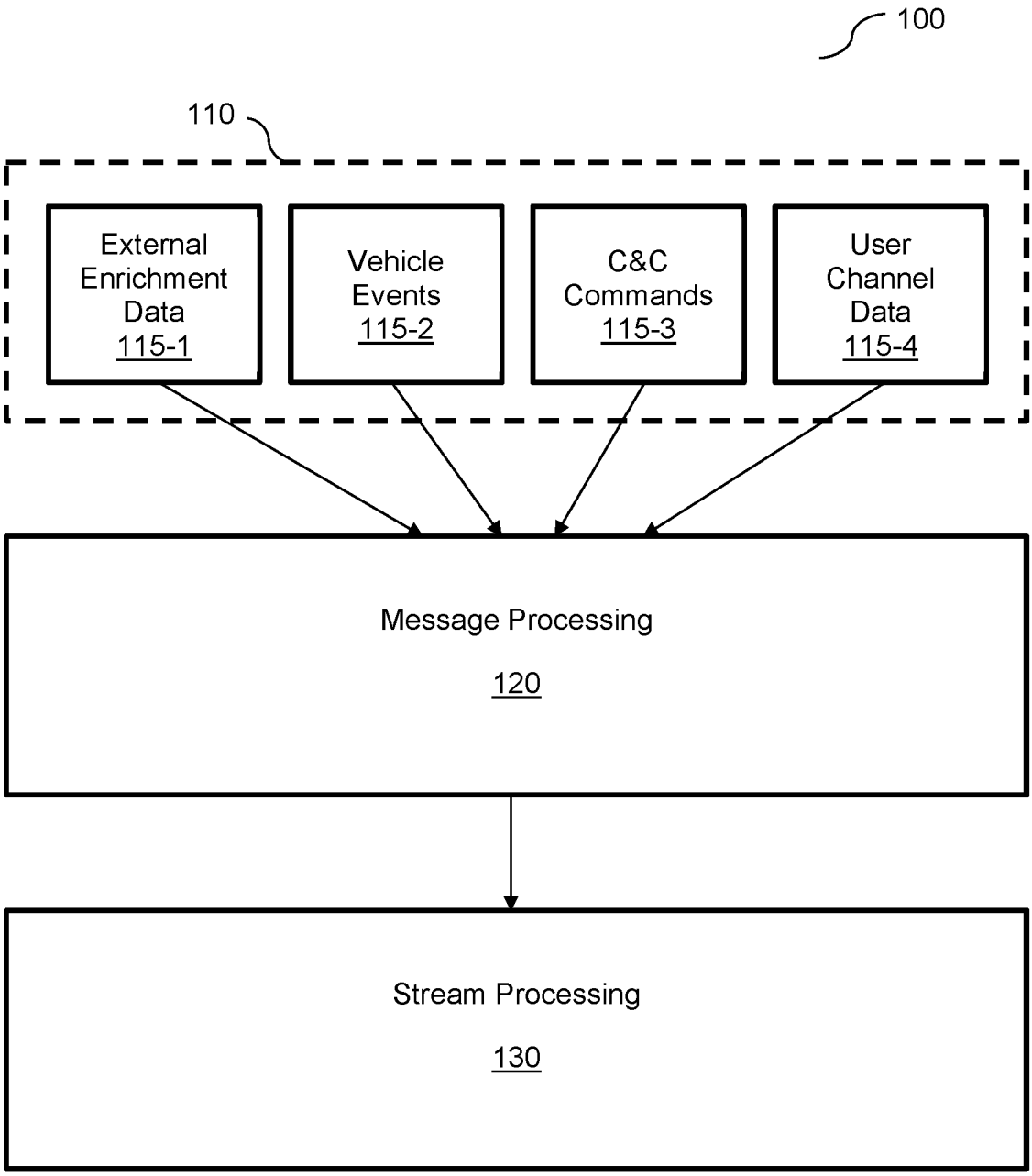
FIG. 1 is a flow diagram illustrating updating contextual vehicle states according to an embodiment.

It is important to note that the embodiments disclosed herein are only examples of the many advantageous uses of the innovative teachings herein. In general, statements made in the specification of the present application do not necessarily limit any of the various claimed embodiments. Moreover, some statements may apply to some inventive features but not to others. In general, unless otherwise indicated, singular elements may be in plural and vice versa with no loss of generality. In the drawings, like numerals refer to like parts through several views.

The various disclosed embodiments include a method and system for contextually monitoring vehicle state. The disclosed embodiments include contextually enhancing vehicle states based on data ingested from multiple sources. The vehicle states include internal state, functional state, applicative state, user data (e.g., data related to an owner or other entity that attempts to cause vehicle actions), and driver state data. To this end, data including messages from vehicle monitoring systems as well as data from other sources is ingested and may be normalized. Messages among the ingested data are enriched. Various embodiments include utilizing machine learning techniques to learn inferences that can subsequently be identified based on features extracted from the ingested data.

In a further embodiment, based on the contextually enhanced vehicle state, one or more violations is detected. The violations may be determined based on contextual rules for the vehicle, the driver, the user, or a combination thereof. Some or all of the contextual rules may be learned via machine learning based on a training set including historical vehicle states. The machine learning may be based further on expected network traffic. The machine learning results in a machine learning model configured to detect unexpected, unreasonable, or otherwise anomalous states or network traffic. The anomalous states or network traffic are anomalous with respect to the context. As a non-limiting example, the machine learning may result in learning that a vehicle does not enter the authenticated state when a driver is not assigned to it. In some implementations, a severity of a violation may be determined, for example, based on occurrence of multiple violations with one or more common vehicle state parameters of the contextually enhanced vehicle states.

The disclosed embodiments provide contextual information related to vehicle use. Specifically, data from different sources is ingested and utilized to contextually enhance vehicle states, thereby allowing for determining meaningful vehicle state inferences based on combinations of data. The contextual enhancement may be performed in real time as a driver interacts with a vehicle such that violations are detected as they occur. In an embodiment, when a violation is detected based on the contextually enhanced vehicle state, an alert is generated. The alert indicates vehicle misuse and may further include instructions for mitigating the abuse. In a further embodiment, the alert may be sent to a vehicle control system.

FIG. 1 is an example flow diagram 100 illustrating updating contextual vehicle states according to an embodiment. In the example flow diagram 100, input data is ingested 110 before message processing 120 and stream processing 130. The flow diagram illustrates a data processing pipeline utilized according to various disclosed embodiments. The data processing pipeline is split into stages to allow for effective large-scale processing in near real-time as new data is received. Each stage is horizontally scalable and resource efficient.

The input data that is ingested 110 includes external enrichment data 115-1, vehicle events 115-2, command and control (C&C) commands 115-3, and user channel data 115-4. To this end, the ingested input data may include telematics related to vehicle behavior and performance.

The external enrichment data 115-1 includes enrichment data from third parties such as, for example, location data, speed limit data, weather data, data from external cyber security sources, analytics, software version (e.g., of a vehicle control system), combinations thereof, and the like.

The vehicle events 115-2 may be provided by vehicle monitoring systems and may include information related to vehicle performance with respect to factors such as movements and vehicle components (e.g., engine). To this end, the vehicle events 115-2 may indicate, but are not limited to, changes in speed, times of events, whether the vehicle is locked, anomalous vehicle behavior detected by vehicle monitoring systems, and the like. The vehicle events 115-2 may be in the form of messages indicating event information.

The C&C commands 115-3 include, but are not limited to, commands from a vehicle control system such as, but not limited to, a C&C server.

The user channel data 115-4 includes data identifying a user such as, for example, a driver of the vehicle. The user channel data 115-4 may include, but is not limited to, a user identifier, a driver identifier, a lease status of the user, and the like. In some implementations, the user channel data 115-4 may include a classification of the driver determined based on data from a telematics channel, for example as described in U.S. patent application Ser. No. 16/174,878, assigned to the common assignee, the contents of which are hereby incorporated by reference.

In an embodiment, the message processing 120 includes normalizing and enriching messages. The messages are included in or based on the vehicle events 115-2. In an embodiment, the normalization may be performed based on predetermined normalization rules, using a machine learning model trained based on historical messages, or a combination thereof. In an embodiment, the message enrichment may be based on predetermined enrichment rules, a machine learning model trained based on historical pre-enrichment and post-enrichment messages, or a combination thereof.

In an embodiment, normalizing the messages includes parsing raw source messages in their original formats and reformatting the source messages into a unified format. To this end, normalizing the messages may further include identifying fields of the source messages and mapping the identified fields to fields of the unified format. The normalization process may be performed more efficiently using machine learning than it would be manually, particularly when the number of fields in source messages is high (e.g., hundreds to thousands). To this end, the normalization may be based on a machine learning model trained to match behavior of unified format fields (e.g., typical values or trends in values) to the identified source fields. In an embodiment, the machine learning model may be a decision tree classifier trained to identify relevant destination fields (i.e., fields of the unified format messages) for each source field. Different moments of the distribution may be used by the classifier such as, but not limited to, standard deviation, median, mean, percentiles, and the like. In a further embodiment, a final decision of the machine learning model may be determined using a probability density function.

In an embodiment, each of ingestion of the input data 110 and the message processing 120 is stateless, i.e., the vehicle state is not known when these stages occur. Accordingly, workload for each of these stages may be distributed equally and randomly among processing nodes (not shown).

The enrichment may include completing missing properties in the message or updating values of properties in the message. Completing the missing properties may include, but is not limited to, identifying predictive properties in the message and determining values for the missing properties as described with respect to FIG. 3. The values of the missing properties may be determined based on predetermined enrichment rules. Alternatively or collectively, some or all of the missing property values may be determined based on a machine learning model trained based on historical messages.

As a non-limiting example for a predetermined enrichment rule, an enrichment rule may be that a value for a missing property of "engine status ON/OFF" is determined to be "OFF" when engine speed is equal to 0. Each enrichment rule may be common among different entities (e.g., for different owners of vehicles, the same rule that engine speed=0 results in engine status "OFF" may apply) or may differ among different entities (e.g., only certain user identities may be determined as authenticated for a company owning vehicles). Each enrichment rule may further be common among different types or groups of vehicles (e.g., different makes, models, etc.) or may be different among different types or groups of vehicles. As a non-limiting example, the rule that engine speed=0 results in engine status "OFF" only applies for certain models or types of vehicle (e.g., non-electric vehicles).

As a non-limiting example for determining a missing property value using machine learning, based on a training set including engine speeds and torques, a model defining a relationship between engine speed and torque is trained. It should be noted that a direct relationship (i.e., between engine speed and torque without other variables) is merely an example, and that more complicated relationships may be equally modeled.

As another non-limiting example, unsupervised training is performed to train a model to determine a risk level of real-time driving behavior. The training is based on a training set including times, driver identifiers, and locations. The training set may be clustered using, for example, K-means clustering with respect to the times, drivers, and locations. For each cluster at a given time, a heatmap is built using kernel density estimation. The heatmaps indicate probabilities of drivers appearing at certain locations at a given time represented by "safe zones" (groupings of locations that are within expectations). When subsequent time, location, and driver data is received, the data may be determined as in or out of the safe zone and, therefore, low or high risk, respectively, based on the heatmap.

The stream processing 130 includes contextually enhancing vehicle state parameters using the enriched messages. In an embodiment, the stream processing may include, but is not limited to, determining a list of ordered events, updating state dimensions according to the list of ordered events and based on the ingested data, and updating a contextual vehicle state to include the updated state dimensions. An example the stream processing 130 is described with respect to FIG. 2.

In an embodiment, the stream processing 130 may be performed in a single processing node (not shown) for each vehicle and, consequently, each user associated with a vehicle. Using a single processing node per vehicle and associated user allows for maintaining vehicle contextual states over time without requiring global data stores, which may present bottlenecks when large numbers of vehicle states must be updated simultaneously. In another embodiment, the stream processing 130 may be distributed among multiple processing nodes.

Figure 2:
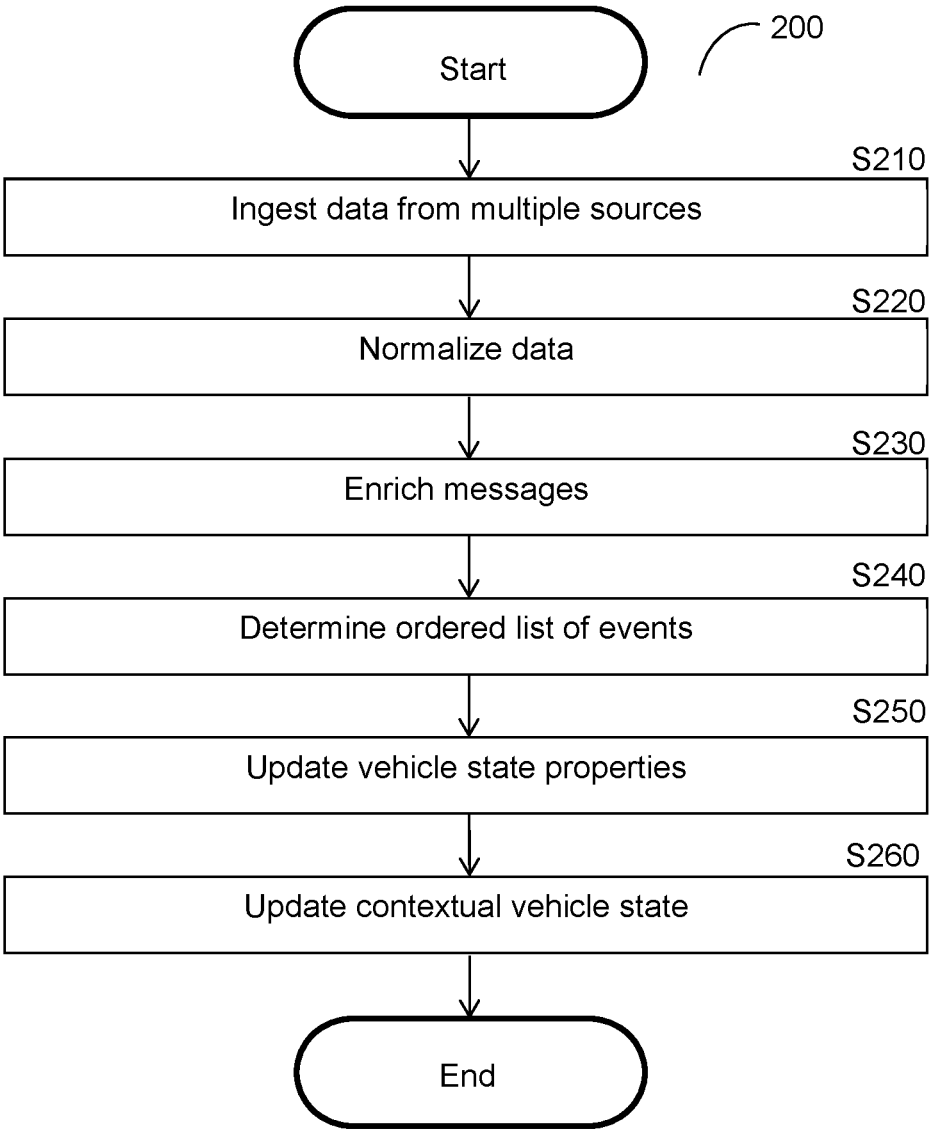
FIG. 2 is a flowchart illustrating a method for updating contextual vehicle states according to an embodiment.

FIG. 2 is an example flowchart 200 illustrating a method for updating contextual vehicle states according to an embodiment. In an embodiment, the method may be performed by the vehicle state monitor 700, FIG. 7.

At S210, data is ingested from multiple sources. The ingested data includes at least messages generated by vehicle monitoring systems. The messages indicate information of events detected by the vehicle monitoring systems. The events may include, but are not limited to, anomalous vehicle behavior. The ingestion includes receiving or otherwise collecting the data.

In an embodiment, the ingested data includes telemetries featuring functional data (e.g., geographical location, speed, door state), mechanical and/or electronics data, or other internal component data (e.g., RPM, odometer, engine control unit state data, etc.) such as, vehicle hard data (e.g., make and model, etc.), software update data (e.g., over the air updates), and telematics data (e.g., events, commands, etc.).

At S220, the ingested data is normalized. Specifically, data is normalized to a unified format such that like information is comparable. As a non-limiting example, for data indicating whether a window is open or closed, such data may be disposed in different fields of two datasets, even if the datasets are from the same entity. Thus, in this example, the normalization includes identifying all indications of window status and creating normalized datasets in unified format with a unified "window status" field that, for each vehicle, contains an identified indication of window status.

In an embodiment, the normalization may further include resolving device discrepancies. As a non-limiting example, data may be buffered.

In an embodiment, S220 includes normalizing messages by extracting fields and values using information retrieval and machine learning techniques. The extracted values are input into fields of a normalized message format. Specifically, the fields and values may be extracted based on predetermined rules, a machine learning model, or a combination thereof. The predetermined rules may define rules for identifying and determining appropriate fields for different values. As a non-limiting example, values expressed in liters or gallons may be identified as belonging to a "fuel" field. The machine learning model used may be the same for different users or may be specific per user. For example, machine learning of historical message data may yield a relationship between RPM and torque for all users such that both RPM and torque values are extracted for a "torque" field. As another example, machine learning of historical message data may yield identifications of numbers in a particular format (e.g., "1234-5678") as driver identifiers for a specific user (e.g., a customer that owns a fleet of vehicles).

At S230, the messages are enriched. The enrichment provides inferences about missing properties in each message based on values of existing properties in the message or in other messages. In an embodiment, the enrichment includes adding a time of ingestion for each message. The times of ingestions for the messages may be utilized for, among other things, determining an ordered list of vehicle events as described further herein below. Enriching messages is now described further with respect to FIG. 3.

Figure 3:
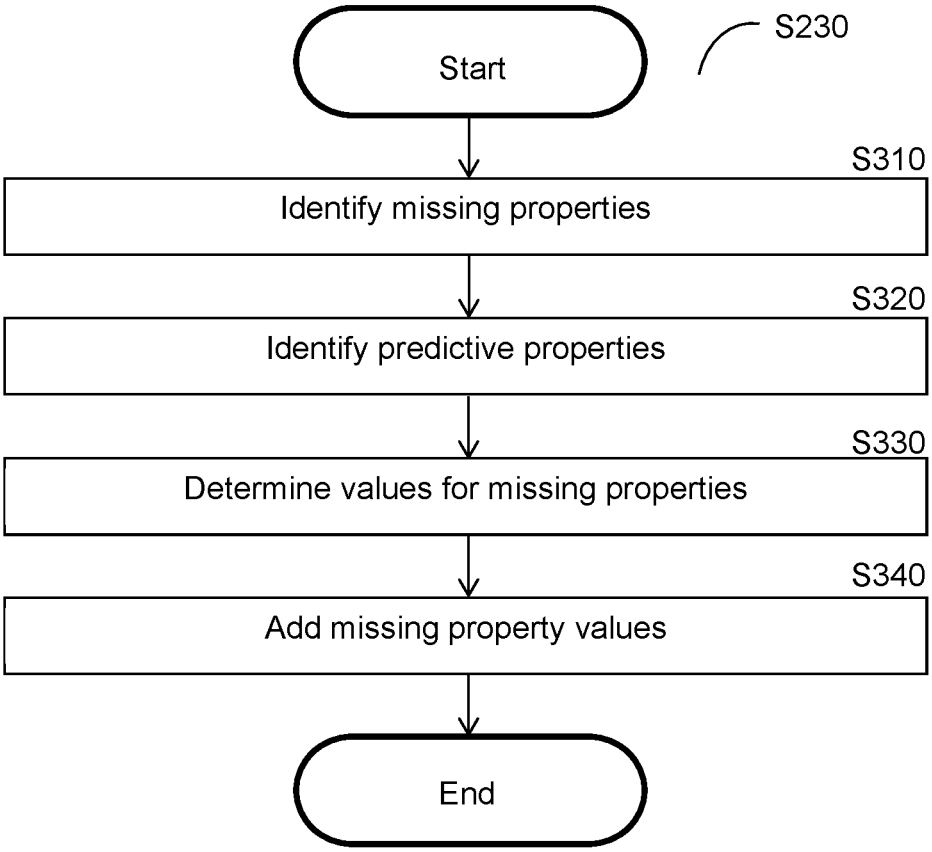
FIG. 3 is a flowchart illustrating a method for enriching an event according to an embodiment.

FIG. 3 is an example flowchart S230 illustrating a method for enriching a message according to an embodiment.

At S310, missing properties in the message are identified. The missing properties may also include, for example, properties having a null, empty, or default value. For example, properties represented fields that are empty may be determined as missing. Alternatively or collectively, the missing properties may include properties that are no longer valid. As a non-limiting example, when a vehicle is moving and new location data has not been received after a period of time (e.g., 10 minutes), the location of the vehicle may be a missing property. In an embodiment, the missing properties include at least a time of ingestion.

At S320, predictive properties are identified. The predictive properties are properties based on which the missing properties can be determined and may be identified within the message, within one or more other messages (e.g., messages from other data sources, messages representing properties at different times, etc.), or both. As a non-limiting example, vehicle location, engine torque, and brake pedal position may be predictive properties for a missing property of "vehicle driving: YES or NO." As another non-limiting example, time, location, and driver identifier may be predictive properties for a risk level of the vehicle behavior. The predictive properties may be predetermined properties associated with known properties that may be missing.

In an embodiment, the predictive properties may be identified using messages from other data sources such that the missing properties are determined based on a fusion of different data sources. To this end, the predictive properties may include predetermined properties from predetermined data sources associated with known properties that may be missing. As a non-limiting example, for a data source providing vehicle data and a data source providing driver data, predictive properties for the vehicle data may be portions of the driver data and predictive properties for the driver data may be the vehicle data.

At S330, values for the missing properties are determined based on the values of the predictive properties. The missing property values are determined based on one or more missing property rules, one or more machine learning models trained based on historical predictive and missing property values, or both. As a non-limiting example for a missing property rule, an engine speed of 0 (a predictive property) yields a vehicle movement status of "NO" for a missing property while an engine speed greater than 0 yields a vehicle movement status of "YES."

At S340, the determined missing property values are added to the message, thereby enriching the message. In an embodiment, the missing property values are only added when the probability of their accuracy is above a threshold. This reduces the likelihood of inaccurate enrichment data. Each probability may be determined based on one or more prediction probability rules or based on a confidence for the machine learning algorithm with respect to the determined value.

In an embodiment, S340 further includes enriching the message with a time of ingestion of the message (i.e., a time at which the message was ingested into the larger set of data). The time of ingestion is utilized for purposes including, but not limited to, determining an ordered list of events.

Returning to FIG. 2, at S240, an ordered list of events is determined with respect to the enriched messages. The ordered list of events may be determined based on timestamps of the enriched messages, times of ingestion, and the like.

At S250, the vehicle state properties are updated based on the enriched messages. In an embodiment, S250 includes executing a state machine with respect to each property. Each state machine is configured to determine new values for the properties based on values of one or more previous contextual vehicle states and an enriched message. In a further embodiment, the configuration of the state machine include training a machine learning model.

In an embodiment, one or more of the vehicle state properties may be updated based on user inputs. The updates based on user inputs may be performed with respect to a context policy defining contextual vehicle states (or portions thereof) prompting user input. The user inputs may be used to, for example, define rules for updating system context, define a custom context, define policies for actions to be taken based on context, and the like. An example rule that may be defined based on user inputs would be "if distance between user and vehicle is greater than 1 km, then vehicle context is 'unauthenticated.'"

The custom context allows for defining explicit rules used to determine at least a portion of a context. For example, a rule for setting a custom context may indicate that RPM>0 and ground speed>0 result in a property of "vehicle driving." As another example, another such custom context rule may indicate that the vehicle being in a predetermined geographic area at night time results in a property of "vehicle at risk." A policy for actions to be taken based on context may be, for example, to generate an alert if the vehicle is driving and the vehicle is at risk.

Training of the machine learning model may be unsupervised. In an example implementation, a hidden Markov model may be utilized for training. The training is based on a training set including all properties of training messages.

In an embodiment, the vehicle state properties may be updated iteratively for each message, where the iterations are ordered based on the ordered list of events. Each iteration may result in a contextual vehicle state representing a snapshot of a distinct point in time and may affect subsequent contextual vehicle states. Because an ordered list of events is determined, messages can arrive in an incorrect or unordered manner but vehicle states may be contextually enhanced in sequence, thereby increasing accuracy of the vehicle states when event order is not predetermined.

In an embodiment, the updated properties include at least an internal state, a functional state, an applicative state, and a driver state. The internal state indicates information related to internal components of the vehicle such as, but not limited to, setup, mechanical condition of parts, condition or state of electronics, software version, engine control unit (ECU) data, and the like. The functional state indicates information related to operation of the vehicle such as location, speed, door state, and the like. The applicative state indicates accessibility or security of the vehicle as reported by remote services such as leased, authorized, locked remotely, and the like. The driver state indicates an identity and other information about the driver of the vehicle.

At S260, the contextual vehicle state is updated based on the updated vehicle state properties. The contextual vehicle state represents the operation of the vehicle in the context of external factors at a given time. To this end, the contextual vehicle state is a snapshot of vehicle state properties at the given time. Contextual vehicle states may be collected from different vehicles (e.g., multiple vehicles within the same fleet, vehicles within different fleets of the same customer, vehicles within different fleets of different customers, etc.) to allow for identifying patterns among different vehicles. Such patterns may allow for root cause analysis of failures.

It should be noted that the order of steps shown in FIG. 2 is an example order, but that other orders of steps may be possible. As a particular example, determining an ordered list of events may be performed prior to or as part of enrichment such that the enrichment includes adding each message's order within the list.

Figure 4:
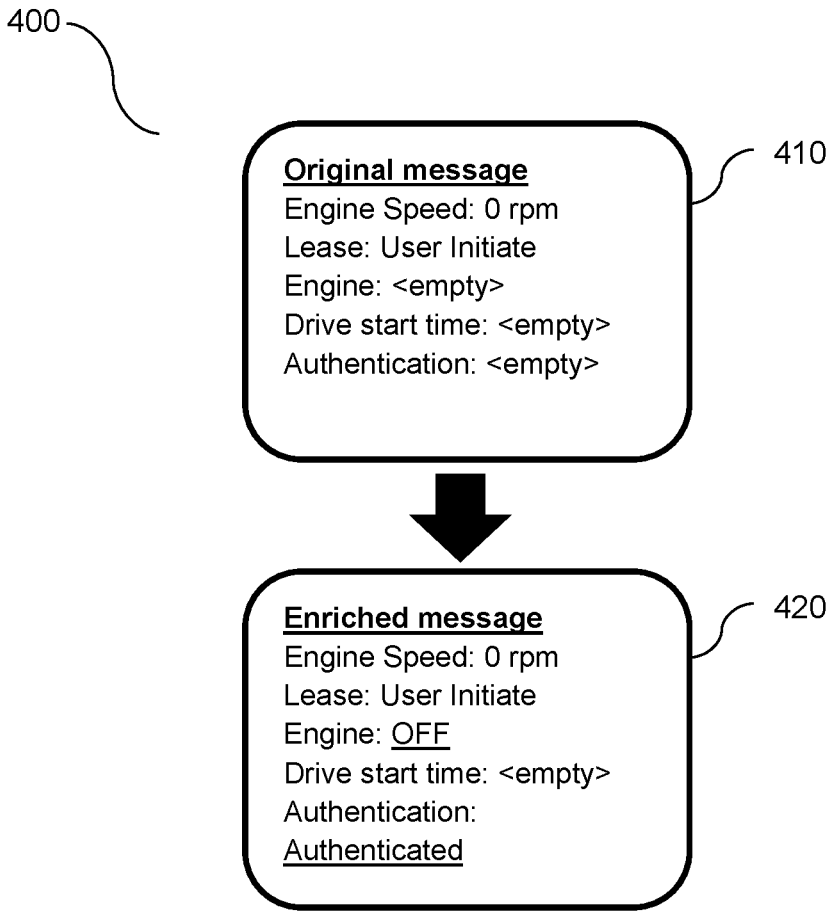
FIG. 4 is an illustration demonstrating event enrichment.

FIG. 4 is an example illustration 400 demonstrating enrichment of an event. The illustration 400 shows an original message 410 and an enriched message 420. The original message 410 includes values for properties including engine speed, leaseholder, engine status, drive start time, and authentication status. Notably, the values for engine status, drive start time, and authentication are empty (i.e., these properties are missing). In the example illustration 400, based on the values of the original message, the missing properties engine status and authentication have been determined and added to the enriched message 420. The added properties include values of "OFF" for engine status determined based on the engine speed of 0 rotations per minute (RPM) as well as the authentication status "Authenticated" based on a predetermined rule defining authorization for the leaseholder "User Initiate."

Figure 5:
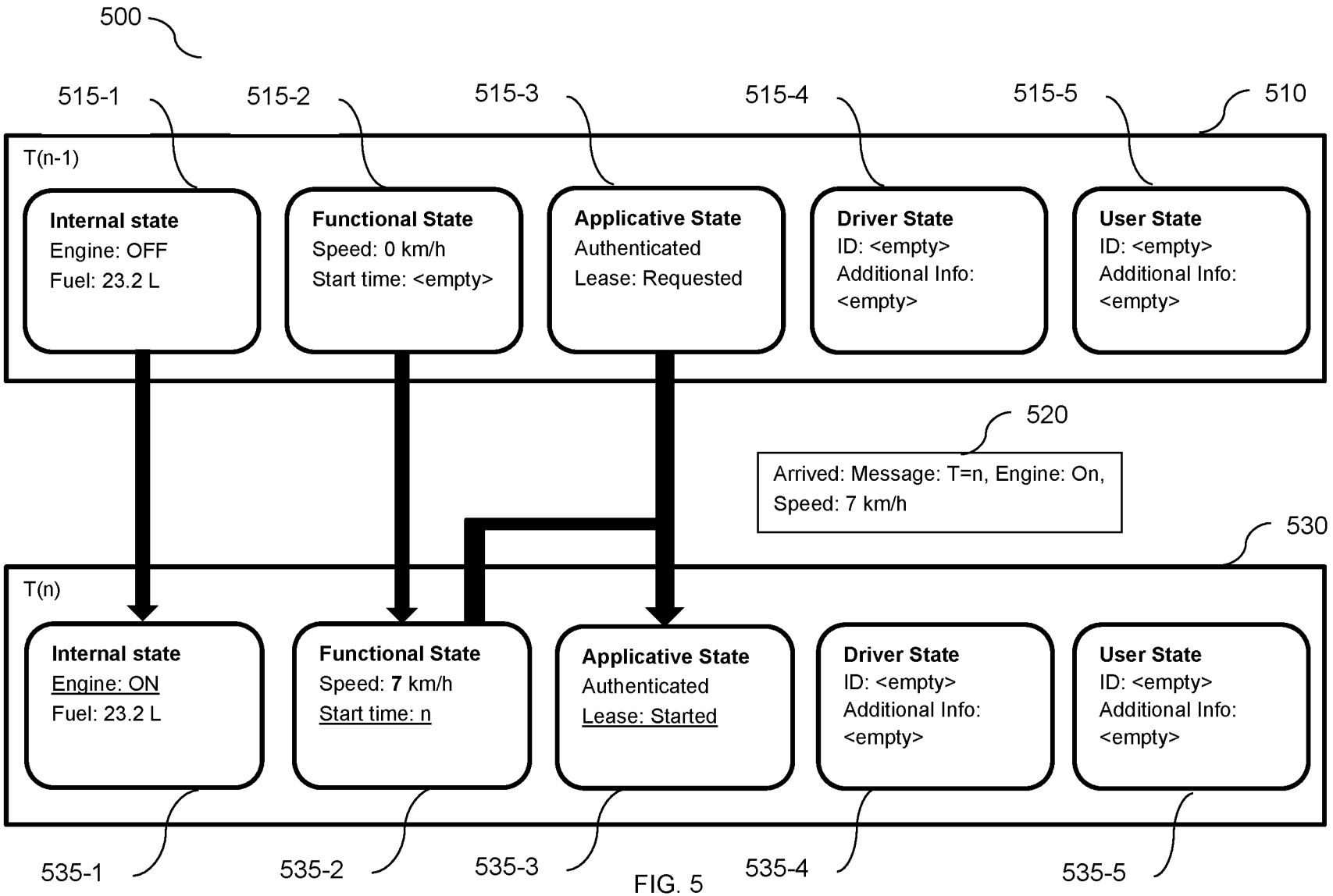
FIG. 5 is an illustration demonstrating contextual vehicle states at two points in time.

FIG. 5 is an example illustration 500 demonstrating contextual vehicle states at two points in time. The illustration 500 demonstrates a first contextual vehicle state 510, a message 520, and a second updated contextual vehicle state 530. The first contextual vehicle state 510 includes a first internal state 515-1, a first functional state 515-2, a first applicative state 515-3, a first driver state 515-4, and a first user state 515-5. When the message 520 is received, the message 520 may be enriched and then used to update the first contextual vehicle state to determine the second updated contextual vehicle state 530.

The second contextual vehicle state 530 includes a second internal state 535-1, a second functional state 535-2, a second applicative state 535-3, a second driver state 535-4, and a second user state 535-5. Each of the second internal state 535-1, the second functional state 535-2, and the second applicative state 535-3 is updated to include a value for a previously empty property of the first contextual vehicle state 510. Specifically, the internal state 535-1 indicates that the engine status is "ON," the functional state 535-3 indicates a start time of "n," and the applicative state 535-3 indicates the beginning of an authenticated lease period.

As an example for determining the second updated contextual vehicle state 530, the driving start time of "n" may be determined based on the following properties: vehicle was idle (i.e., speed of 0 km/h) at time T(n−1), vehicle is moving (i.e., speed of 7 km/h) at time T(n), and there is no change in fuel level (23.2 L) between time T(n−1) and time T(n). As another example for determining the second updated contextual vehicle state 530, the lease state "started" may be determined based on the lease state "requested" at time T(n−1) and the vehicle moving (i.e., speed of 7 km/h) at time T(n).

Figure 6:
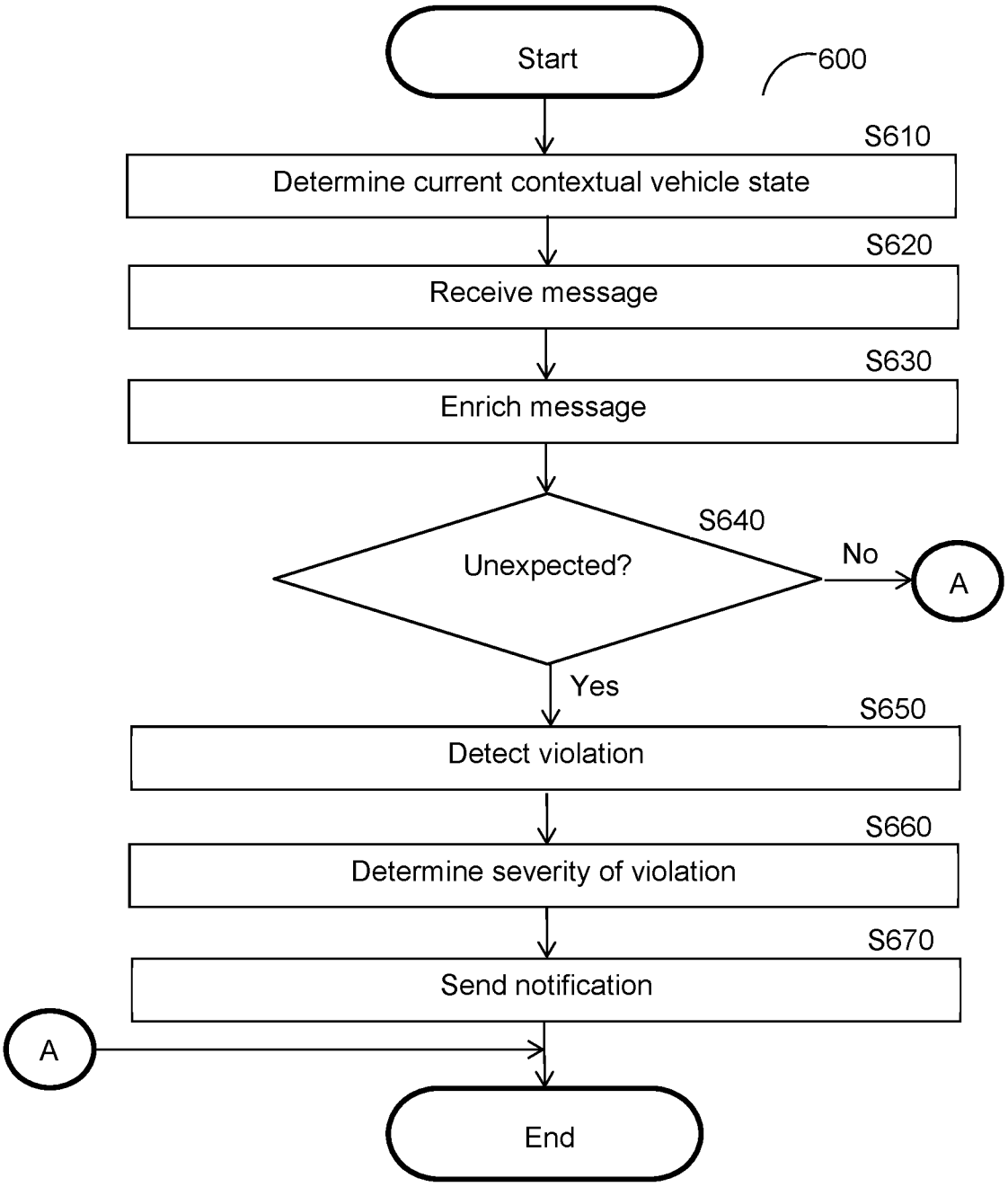
FIG. 6 is a flowchart illustrating a method for identifying violations based on contextual vehicle states according to an embodiment.

FIG. 6 is an example flowchart 600 illustrating a method for identifying violations based on contextual vehicle states according to an embodiment. In an embodiment, the method of FIG. 6 is performed based on contextually enhanced vehicle states created as described herein with respect to FIG. 2.

At S610, a contextually enhanced vehicle state is determined. In an embodiment, the current contextual vehicle state is determined as described with respect to FIG. 2.

At S620, a new message is received. The message indicates a vehicle event that may cause a change in state. The message is generated by and received from a vehicle monitoring system in real-time as interactions with the vehicle occur. The interactions may be, but are not limited to, operating the vehicle (e.g., using the gas pedal, brakes, steering wheel, etc.), locking or unlocking the vehicle, logging in to a vehicle's control system (for authentication-based vehicle control systems), and the like. The interactions cause changes in the contextual vehicle state that may result in violations of one or more violation rules.

At S630, the message is enriched. The enrichment includes adding values for missing properties based on existing values of predictive properties in the message or in other messages. The enrichment may be performed as described herein. In an embodiment, S630 may also include normalizing the message into a unified message format.

At S640, it is determined whether any values of one or more properties in the enriched message are unexpected and, if so, execution continues with S650; otherwise, execution terminates. In some implementations, if no values are unexpected, execution may continue with S610, where the contextual vehicle state is updated based on the enriched message and execution proceeds to S620 when a new message is received. This allows for continuous monitoring for violations.

Whether a value of a message property is unexpected may be determined based on one or more predetermined violation rules (e.g., system violation rules, user violation rules, etc.) or based on a machine learning model trained using a training set including normal and abnormal contextually enhanced vehicle states. Each of the rules and the machine learning model may be used across any of the vehicles (e.g., fuel quantity of 0 may be a violation for any vehicle) or may be only be used for specific vehicles (e.g., fuel quantity less than ⅓ of maximum capacity may be a violation for a first vehicle and fuel quantity less than ⅛ of maximum capacity may be a violation for a second vehicle). In some implementations, some of the violation rules may be explicitly defined by a user (e.g., a customer communicating via a user device).

The violation rules are contextual rules for identifying violations based on properties of the current contextual vehicle state. Example actions that may be considered violations under the violation rules may include, but are not limited to, replaying an old message, receiving an out of state message for a user that is only authorized for in state activity, performing a forbidden action in context (e.g., stopping the engine while driving), an unexpected activity in context as compared to historical states (e.g., decelerating while on a highway), anomalous behavior following an over-the-air (OTA) update, identity theft (e.g., use of a vehicle by an unauthorized person), fuel theft (e.g., decrease in fuel quantity when the vehicle is stopped), and the like.

At S650, when an unexpected state is determined, a violation is detected. At optional S660, a severity of the violation may be determined. The severity may be based on, but not limited to, a number of violations sharing a common context with the violation, a number of violations occurring nearby, or a combination thereof. For example, when multiple violations are detected based on contextually enhanced vehicle states generated within an hour of an OTA update, the severity of each violation may be higher than when only a single instance of the violation occurs during the hour. As another example, multiple violations in the same geographic area may result in high severity for each violation.

At S670, a notification indicating the violation may be sent to, for example, a user device associated with the vehicle. The notification may indicate the contextual vehicle state, the violation, the severity of the violation, combinations thereof, and so on. Alternatively or collectively, S670 may include adding the contextual vehicle state demonstrating the violation to a command, an event, or both. This allows for creating an audit trail that can be utilized for root cause analysis and subsequent investigations into vehicle failures.

Figure 7:
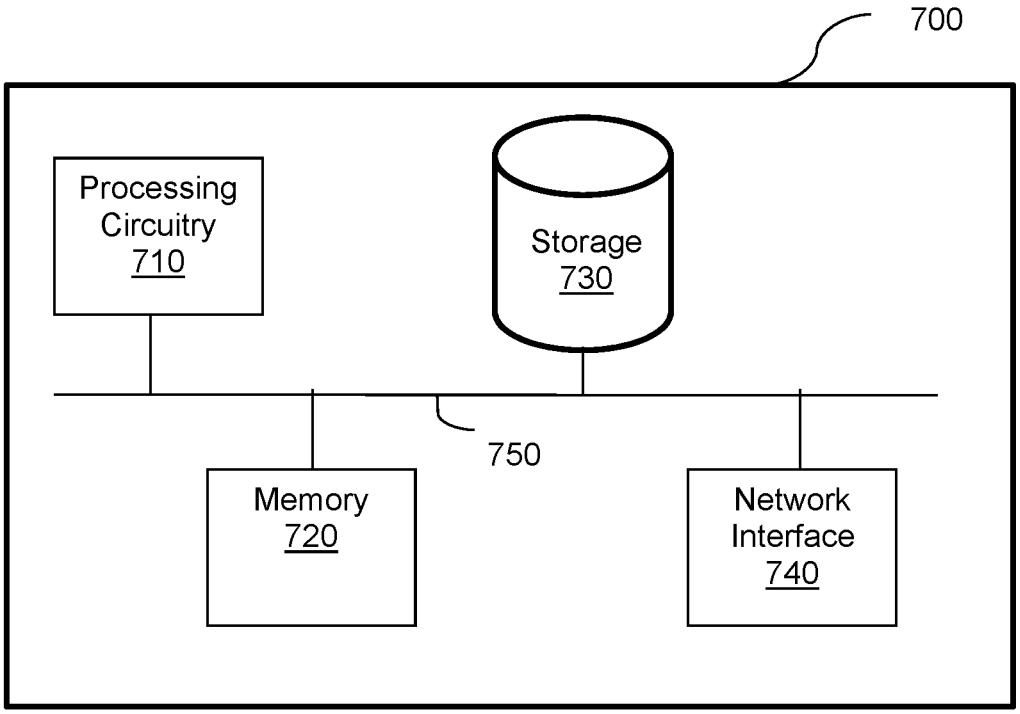
FIG. 7 is a schematic diagram of a vehicle state monitor according to an embodiment.

FIG. 7 is an example schematic diagram of the vehicle state monitor 700 according to an embodiment. The vehicle state monitor 700 includes a processing circuitry 710 coupled to a memory 720, a storage 730, and a network interface 740. In an embodiment, the components of the vehicle state monitor 700 may be communicatively connected via a bus 750.

The processing circuitry 710 may be realized as one or more hardware logic components and circuits. For example, and without limitation, illustrative types of hardware logic components that can be used include field programmable gate arrays (FPGAs), application-specific integrated circuits (ASICs), Application-specific standard products (ASSPs), system-on-a-chip systems (SOCs), graphics processing units (GPUs), tensor processing units (TPUs), general-purpose microprocessors, microcontrollers, digital signal processors (DSPs), and the like, or any other hardware logic components that can perform calculations or other manipulations of information.

The memory 720 may be volatile (e.g., RAM, etc.), non-volatile (e.g., ROM, flash memory, etc.), or a combination thereof. In one configuration, computer readable instructions to implement one or more embodiments disclosed herein may be stored in the storage 730.

In another embodiment, the memory 720 is configured to store software. Software shall be construed broadly to mean any type of instructions, whether referred to as software, firmware, middleware, microcode, hardware description language, or otherwise. Instructions may include code (e.g., in source code format, binary code format, executable code format, or any other suitable format of code). The instructions, when executed by the processing circuitry 710, configure the processing circuitry 710 to perform the various processes described herein.

The storage 730 may be magnetic storage, optical storage, and the like, and may be realized, for example, as flash memory or other memory technology, CD-ROM, Digital Versatile Disks (DVDs), or any other medium which can be used to store the desired information.

The network interface 740 allows the vehicle state monitor 700 to communicate for the purpose of, for example, receiving vehicle and driver state data.

It should be understood that the embodiments described herein are not limited to the specific architecture illustrated in FIG. 7, and other architectures may be equally used without departing from the scope of the disclosed embodiments.

It should be noted that various embodiments are described with respect to vehicles and that such vehicles may include any systems adapted for locomotion including, but not limited to, cars, trucks, ships, planes, robots, and the like.

The various embodiments disclosed herein can be implemented as hardware, firmware, software, or any combination thereof. Moreover, the software is preferably implemented as an application program tangibly embodied on a program storage unit or computer readable medium consisting of parts, or of certain devices and/or a combination of devices. The application program may be uploaded to, and executed by, a machine comprising any suitable architecture. Preferably, the machine is implemented on a computer platform having hardware such as one or more central processing units ("CPUs"), a memory, and input/output interfaces. The computer platform may also include an operating system and microinstruction code. The various processes and functions described herein may be either part of the microinstruction code or part of the application program, or any combination thereof, which may be executed by a CPU, whether or not such a computer or processor is explicitly shown. In addition, various other peripheral units may be connected to the computer platform such as an additional data storage unit and a printing unit. Furthermore, a non-transitory computer readable medium is any computer readable medium except for a transitory propagating signal.

All examples and conditional language recited herein are intended for pedagogical purposes to aid the reader in understanding the principles of the disclosed embodiment and the concepts contributed by the inventor to furthering the art, and are to be construed as being without limitation to such specifically recited examples and conditions. Moreover, all statements herein reciting principles, aspects, and embodiments of the disclosed embodiments, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

It should be understood that any reference to an element herein using a designation such as "first," "second," and so forth does not generally limit the quantity or order of those elements. Rather, these designations are generally used herein as a convenient method of distinguishing between two or more elements or instances of an element. Thus, a reference to first and second elements does not mean that only two elements may be employed there or that the first element must precede the second element in some manner. Also, unless stated otherwise, a set of elements comprises one or more elements.

As used herein, the phrase "at least one of" followed by a listing of items means that any of the listed items can be utilized individually, or any combination of two or more of the listed items can be utilized. For example, if a system is described as including "at least one of A, B, and C," the system can include A alone; B alone; C alone; 2A; 2B; 2C; 3A; A and B in combination; B and C in combination; A and C in combination; A, B, and C in combination; 2A and C in combination; A, 3B, and 2C in combination; and the like.

What is claimed is:

1. A method for contextually monitoring vehicle states, comprising:

enhancing the plurality of messages based on at least one missing property value and the plurality of predictive properties in the plurality of messages, wherein at least one message of the plurality of messages is generated by a vehicle monitoring system, wherein each message of the plurality of messages is ingested at a vehicle state monitor, wherein each of the predictive properties is a property indicated in one of the plurality of messages of a predetermined type of property;

executing a plurality of state machines, wherein each state machine is configured to determine a value for at least one respective vehicle state property of a plurality of vehicle state properties based on at least one previously generated contextual vehicle state and the enhanced plurality of messages; and generating a contextual vehicle state for a vehicle based on the enhanced plurality of messages and the value determined by each of the plurality of state machines, wherein the contextual vehicle state is a snapshot of a plurality of vehicle state properties at a given time.

2. The method of claim 1, further comprising:

determining an ordered list of vehicle events based on the plurality of messages, wherein the contextual vehicle state is generated based further on the ordered list of vehicle events.

3. The method of claim 2, wherein each message of the plurality of messages includes a timestamp, wherein the ordered list of vehicle events is determined based on the timestamps of the plurality of messages.

4. The method of claim 1, wherein the enhancing further comprises:

determining at least one enhancement value for at least one first missing value of the at least one missing value based on at least one first predictive property of the plurality of predictive properties, wherein the at least one first predictive property and the at least one first missing value are included in a first message of the plurality of messages; and adding the at least one enhancement value to the first message.

5. The method of claim 4, wherein the enhancing further comprises:

determining at least one enhancement value for the at least one first missing value based on at least one first predictive property of the plurality of predictive properties, wherein the at least one first predictive property is included in a first message of the plurality of messages, wherein the at least one first missing value is included in at least one second message of the plurality of messages, wherein the at least one second message excludes the first message; and adding the at least one enhancement value to the first message.

6. The method of claim 1, wherein the plurality of messages includes messages from at least two data sources, wherein at least one first message of the plurality of messages is enhanced based on at least one predictive property of the plurality of predictive properties included in at least one second message of the plurality of messages, wherein the at least one first message and the at least one second message are from different data sources of the at least two data sources.

7. The method of claim 1, wherein each state machine includes a machine learning model trained to determine future vehicle state properties based on past vehicle state properties.

8. The method of claim 1, further comprising:

identifying at least one missing property in the plurality of messages;

identifying the plurality of predictive properties in the plurality of messages;

determining the at least one missing property value for the identified at least one missing property based on the plurality of predictive properties; and determining a probability that each of the at least one missing property value is accurate, wherein enhancing the plurality of messages includes adding each of the at least one missing property value having a probability above a threshold.

9. The method of claim 1, further comprising:

detecting at least one violation based on the contextual vehicle state and at least one violation rule.

10. The method of claim 1, wherein a state of the vehicle is not known during enhancing of the plurality of messages, wherein a workload for the enhancement of the plurality of messages is distributed equally and randomly among a plurality of processing nodes.

11. A non-transitory computer readable medium having stored thereon instructions for causing a processing circuitry to execute a process, the process comprising:

enhancing the plurality of messages based on at least one missing property value and the plurality of predictive properties in the plurality of messages, wherein each message of the plurality of messages is generated by a vehicle monitoring system and ingested at a vehicle state monitor, wherein each of the predictive properties is a property indicated in one of the plurality of messages of a predetermined type of property;

executing a plurality of state machines, wherein each state machine is configured to determine a value for at least one respective vehicle state property of a plurality of vehicle state properties based on at least one previously generated contextual vehicle state and the enhanced plurality of messages; and generating a contextual vehicle state for a vehicle based on the enhanced plurality of messages and the value determined by each of the plurality of state machines, wherein the contextual vehicle state is a snapshot of a plurality of vehicle state properties at a given time.

12. A system for contextually monitoring vehicle states, comprising:

a processing circuitry; and a memory, the memory containing instructions that, when executed by the processing circuitry, configure the system to:

enhance the plurality of messages based on at least one missing property value and the plurality of predictive properties in the plurality of messages, wherein each message of the plurality of messages is generated by a vehicle monitoring system and ingested at the system, wherein each of the predictive properties is a property indicated in one of the plurality of messages of a predetermined type of property;

execute a plurality of state machines, wherein each state machine is configured to determine a value for at least one respective vehicle state property of a plurality of vehicle state properties based on at least one previously generated contextual vehicle state and the enhanced plurality of messages; and generate a contextual vehicle state for a vehicle based on the enhanced plurality of messages and the value determined by each of the plurality of state machines, wherein the contextual vehicle state is a snapshot of a plurality of vehicle state properties at a given time.

13. The system of claim 12, wherein the system is further configured to:

determine an ordered list of vehicle events based on the plurality of messages, wherein the contextual vehicle state is generated based further on the ordered list of vehicle events.

14. The system of claim 13, wherein each message of the plurality of messages includes a timestamp, wherein the ordered list of vehicle events is determined based on the timestamps of the plurality of messages.

15. The system of claim 14, wherein the system is further configured to:

determine at least one enhancement value for at least one first missing value based on at least one first predictive property of the plurality of predictive properties, wherein the at least one first predictive property and the at least one first missing value are included in a first message of the plurality of messages; and add the at least one enhancement value to the first message.

16. The system of claim 12, wherein the system is further configured to:

determine at least one enhancement value for the at least one first missing value based on at least one first predictive property of the plurality of predictive properties, wherein the at least one first predictive property is included in a first message of the plurality of messages, wherein the at least one first missing value is included in at least one second message of the plurality of messages, wherein the at least one second message excludes the first message; and add the at least one enhancement value to the first message.

17. The system of claim 12, wherein the plurality of messages includes messages from at least two data sources, wherein at least one first message of the plurality of messages is enhanced based on at least one predictive property of the plurality of predictive properties included in at least one second message of the plurality of messages, wherein the at least one first message and the at least one second message are from different data sources of the at least two data sources.

18. The system of claim 10, wherein each state machine includes a machine learning model trained to determine future vehicle state properties based on past vehicle state properties.

19. The system of claim 12, wherein the system is further configured to:

identify at least one missing property in the plurality of messages;

identify the plurality of predictive properties in the plurality of messages;

determine the at least one missing property value for the identified at least one missing property based on the plurality of predictive properties; and determine a probability that each of the at least one missing property value is accurate, wherein enhancing the plurality of messages includes adding each of the at least one missing property value having a probability above a threshold.

20. The system of claim 12, wherein the system is further configured to:

detect at least one violation based on the contextual vehicle state and at least one violation rule.

21. The system of claim 12, wherein a state of the vehicle is not known during enhancement of the plurality of messages, wherein a workload for the enhancement of the plurality of messages is distributed equally and randomly among a plurality of processing nodes.

* * * * *